US008220178B2

(12) United States Patent
Schellstede

(10) Patent No.: US 8,220,178 B2
(45) Date of Patent: Jul. 17, 2012

(54) HIGH EFFICIENCY LIQUID SOLID SEPARATOR

(76) Inventor: Herman J. Schellstede, New Iberia, LA (US)

( * ) Notice: Subject to any disclaimer, the term of this patent is extended or adjusted under 35 U.S.C. 154(b) by 1446 days.

(21) Appl. No.: 11/270,685

(22) Filed: Nov. 9, 2005

(65) Prior Publication Data

US 2006/0096119 A1 May 11, 2006

Related U.S. Application Data

(60) Provisional application No. 60/626,548, filed on Nov. 9, 2004.

(51) Int. Cl.
*F26B 3/34* (2006.01)

(52) U.S. Cl. ..... 34/247; 34/412; 34/92

(58) Field of Classification Search ..... 34/247, 34/179, 380, 406, 408, 412, 92; 219/667, 219/656, 653; 210/416.1, 455, 484
See application file for complete search history.

(56) References Cited

U.S. PATENT DOCUMENTS 2,144,618 A * 1/1939 Clark ..... 373/144
3,976,018 A * 8/1976 Boulet ..... 110/225
5,216,821 A * 6/1993 McCabe et al. ..... 34/426
6,608,290 B1 * 8/2003 Robinson ..... 219/653
2002/0148829 A1 * 10/2002 Fishman ..... 219/656

FOREIGN PATENT DOCUMENTS

JP 2002221863 A * 8/2002

OTHER PUBLICATIONS

English tranlation of Oomoto et al. (JP 2002221863), Aug. 2002.*

* cited by examiner

*Primary Examiner* — Jiping Lu
(74) *Attorney, Agent, or Firm* — Roy Kiesel Ford Doody and Thurmon

(57) ABSTRACT

A liquid solid separator utilizing inductive heating. An electrically conductive scroll conveyor is contained within a non-magnetic and non-conductive housing under vacuum. A moveable alternating electric coil is disposed around the housing. The scroll pulls the solids through the housing. Operation of the coil heats the scroll which heats the solids. The vacuum lowers the boiling point of the liquids, and they are vaporized at a relatively low temperature. The vapors are condensed and collected. Because of the low temperatures, the separated liquids are less likely to deteriorate during separation, facilitating recycling. Thermocouples and a computer track the internal temperature of the separator and coordinate the position of the coil to maintain the desired temperature. The housing is provided with a heat insulating outer layer and the interior of the scroll is pressurized with nitrogen. The separator surfaces exposed to the atmosphere are maintained at or below 150° F.

31 Claims, 8 Drawing Sheets

HIGH EFFICIENCY LIQUID SOLID SEPARATOR

PRIORITY

This application claims priority of U.S. provisional application No. 60/626,548, filed Nov. 9, 2004, and which is hereby incorporated by reference in its entirety.

BACKGROUND THE INVENTION

1. Field of the Invention

The invention relates to liquid solid separation in general and to thermal desorption in particular.

2. Prior Art

The need to separate solids from liquids arises in many contexts from mining to shipping to waste treatment. Several specialized separation problems are presented in the context of petroleum exploration. In many petroleum exploration and production operations and particularly in applications involving deeper wells, a hydrocarbon based drilling fluid is employed to perform many functions. This drilling fluid generally serves as a hydraulic fluid to drive down hole tools, such as a mud motor, which will turn the drill bit at the leading end of the drill string. The drilling fluid will also serve to lubricate the drill bit.

As the drill bit turns, it will generate cuttings which must be removed from the well bore for the bore to grow. The pressure on the drilling fluid forcing it down the drill string and through the mud motor will also cause the fluid to rise back up the well in the annular space between the drill string and the well wall. The pressure exerted by the drilling fluid will help support the well wall and keep it from collapsing. The flow of the drilling fluid will also carry the cuttings from the well bottom to the surface. Once at the surface, the cuttings will be extracted from the drilling fluid so that the fluid may be reused in operation of the well. However, the separated cuttings will be soaked in the hydrocarbon based drilling fluid, which by that point, may also include water and/or petroleum emitted by the well. Generally, at this stage the separated cuttings will be contained in a thick oil based slurry.

The condition of the cuttings creates disposal problems. During drilling many, many tons of cuttings will be produced. In offshore operations, environmental regulations as well as principles of sound environmental stewardship prevent operators from simply dumping the cuttings overboard, since to do so would result in the discharge of a substantial quantity of oil into the water. Similarly, in land based operations, the easiest thing to do with the cuttings would be to bury them. However, the presence of the oil based fluids on the cuttings make this impossible because of the risk that the oil will contaminate ground water supplies. Thus, the oil must be separated from the cuttings before the cuttings can be disposed.

Because of the quantities and distances involved, transporting the cuttings to a treatment facility can be prohibitively expensive. Thus, treatment on site is preferable. However, treatment on site creates a whole new set of difficulties.

In many petroleum wells, a substantial amount of natural gas is generated. Sometimes the gas is the primary intended product of the well. Sometimes gas is extracted as a bi-product of a well whose primary product is crude. In either case, gas is often present during exploration and production.

Natural gas is highly flammable. While modem wells are designed to capture the gas released during exploration and production, there is always a risk that the system for capturing the gas will fail—known in the field as a "blow out." A blow out creates a serious fire and explosion hazard for well operators, and as a result extreme care must be taken to ensure that no potential flash points are present. The care shown by rig operators in this case is a result of both sound rig safety policies and government safety regulations.

Separation of the cuttings and the oil based drilling fluids usually involves heat. For example, one common separator is a rotary kiln, in which electric current is passed through a heating coil. However, such prior art separators often have excessively hot portions that are exposed to the atmosphere. If a gas cloud were released in a blow out, such exposed portions of the separators could potentially be a flash point capable of igniting the gas cloud and causing fires and/or explosions. Such hot spots make the presence of many prior art separators at petroleum production facilities potentially dangerous.

One common industry solution to this risk is to build separate platforms or platform extensions for the separator at a distance from the location of any likely gas discharge. Given the premium for space in offshore exploration and production operations, such solutions can be very expensive. Moreover, depending upon wind and other environmental conditions at the time of a blow out, physical separation of the separator may not be sufficient to entirely eliminate the risk posed unless the separation distance is very great.

In addition to the foregoing shortcomings, such prior art separators are also often relatively costly and inefficient. Therefore, a liquid solid separator meeting the following objectives is desired.

OBJECTS OF THE INVENTION

It is an object of the invention to provide a liquid solid separator that is capable of separating well cutting from oil based drilling fluid.

It is another object of the invention to provide a liquid solid separator without hot points exposed to the atmosphere.

It still another object of the invention to provide a liquid solid separator that operates using inductive heating.

It is yet another object of the invention to provide a liquid solid separator that is energy efficient.

It is still another objection of the invention to provide a liquid solid separator that is capable of rendering a liquid separate that is suitable for recycling.

SUMMARY OF THE INVENTION

The invention comprises a liquid solid separator. It is most preferably used to separate oil and water contamination from petroleum well cuttings. In the preferred embodiment a mechanical dryer is first used to reduce the excess liquid content of the cuttings, preferably to about eighteen percent (6.8% oil and 11.2% water). Next the cuttings are transferred to a serge unit to facilitate steady loading of the induction dryer. The induction dryer comprises an induction chamber, the essential components of which are a housing and a conveyor positioned inside the housing. The conveyor is made of an electrically conductive material that is preferably relatively resistant to electric current. The housing is made of a material that is both substantially non-magnetic and substantially non-conductive to electricity. Each end of the housing is sealed to make the housing substantially air tight, and a vacuum pump maintains a vacuum within the housing.

As the cuttings are loaded into the induction dryer, the conveyor will pull the cuttings through the housing in the space between the conveyor and the housing. A moveable alternating electric coil is positioned around the housing. As the coil moves back and forth over the housing, the current will induce an alternating and opposite electric current in the conveyor. The resistance of the conveyor to the alternating electric current will cause the conveyor to become heated. The degree of heating can be controlled by controlling the rate of motion of the coil.

As the conveyor is heated, it will transfer that heat to the cuttings lying on it. As the cuttings are heated, the liquid contaminants contained in the cuttings will be vaporized. As the contaminants are vaporized, the vacuum pump will draw them away from the cuttings, thereby separating the solid cuttings components from the liquid contaminants. The vacuum also allows the contaminants to be vaporized at a lower temperature than would be possible under atmospheric conditions. Energy is saved because the separator does not have to expend the energy necessary to reach the higher temperatures that would be required to vaporize the contaminants at atmospheric pressure.

A wizzard is preferably provided in the vacuum stream to remove any small solid particles that become entrained in the vapor stream. The vapor stream is condensed for further treatment, recycling, or disposal. Similarly, the cuttings are collected. Once they are free from the liquid contaminants, the cuttings may be used as construction material or they may be discharged into the waters or buried in a landfill without adverse environmental consequences.

The housing is preferably provided with an insulating outer layer. Because the housing is constructed of non-magnetic and non-electrically conductive material, there will be little or no inductive effect on the housing. Any heating of the housing will be via conventional heat transfer from the heated conveyor and cuttings, and this will be minimized by the insulating effects of the vacuum. The insulating outer layer of the housing will prevent any minimal heating of the housing from being exposed to the atmosphere. This will prevent the housing from becoming a potential flash point in the event of a flammable gas leak in the vicinity of the separator. In addition to saving energy, the use of the vacuum to minimize the temperatures the separator must obtain in order to vaporize the liquid contaminants also makes it easier to keep the housing exterior from becoming overheated.

The interior of the conveyor is also preferably pressurized with a non-flammable gas, such as nitrogen. This will minimize the chance that any flammable gases that might be present in the atmosphere could contact the interior of the heated conveyor. The housing and the seals between the housing and the conveyor will prevent any such flammable gases from contacting the exterior of the heated conveyor. Thus, all heated portions of the separator are effectively shielded from contact with any flammable gases that maybe present in the environment surrounding the separator from time to time.

DETAILED DESCRIPTION OF THE PREFERRED EMBODIMENT

Figure 1:
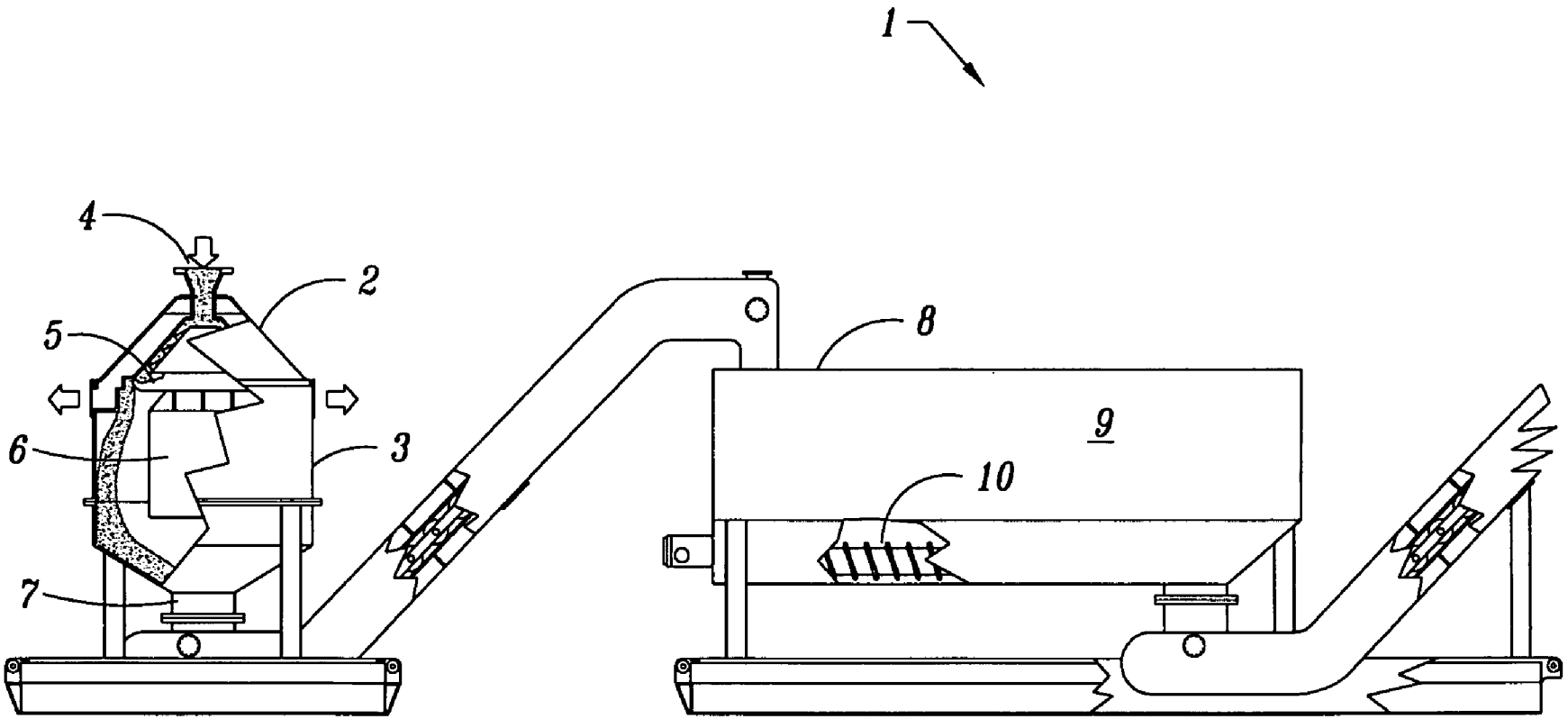
FIG. 1 is a side view with partial cut-away views of a preferred embodiment of certain components a preferred separator, namely a mechanical dryer and a serge tank.
Figure 2:
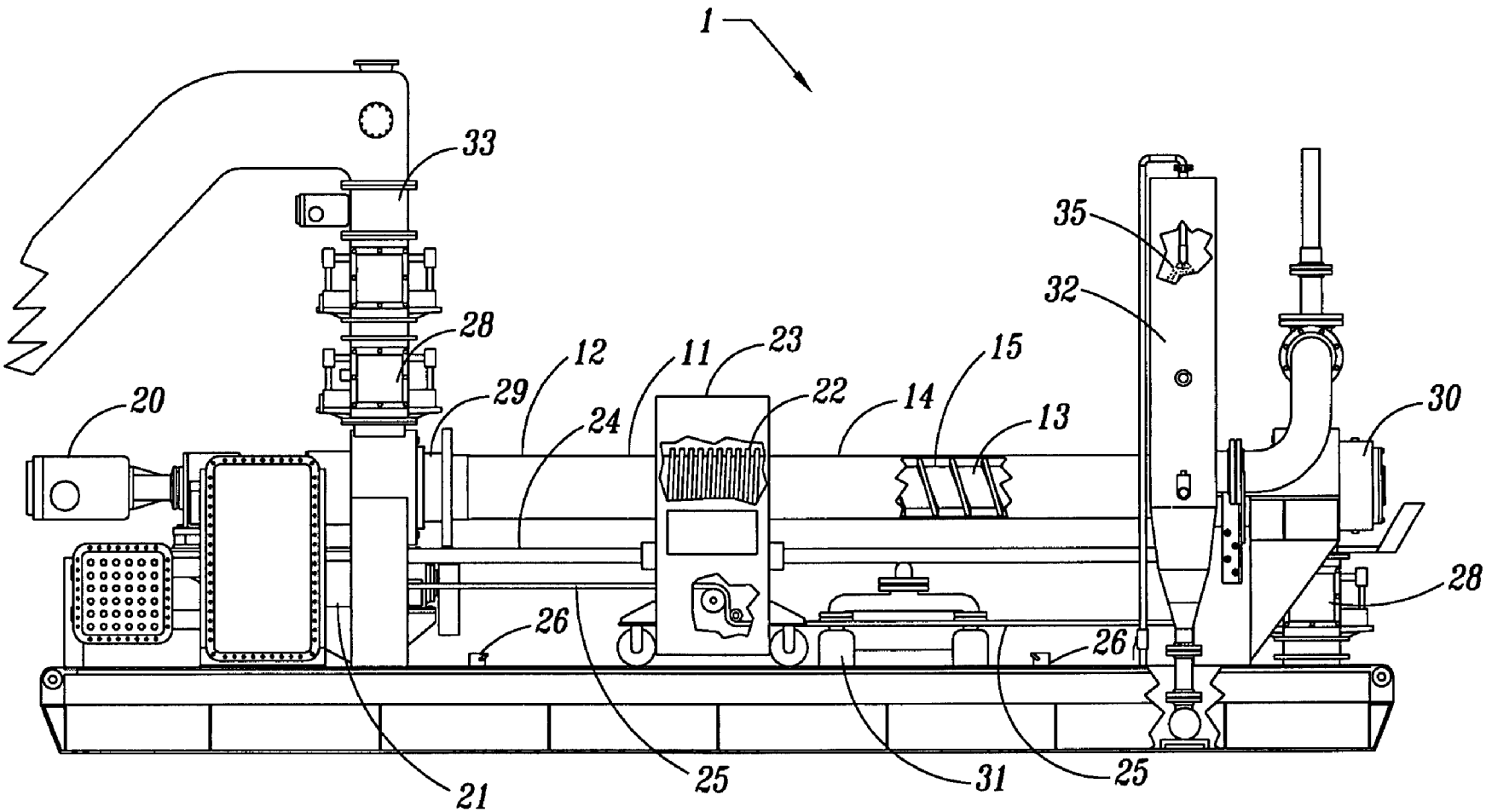
FIG. 2 is a continuation of the view of a preferred embodiment of a preferred separator shown in FIG. 1, but showing an induction dryer and condensing chamber.
Figure 3:
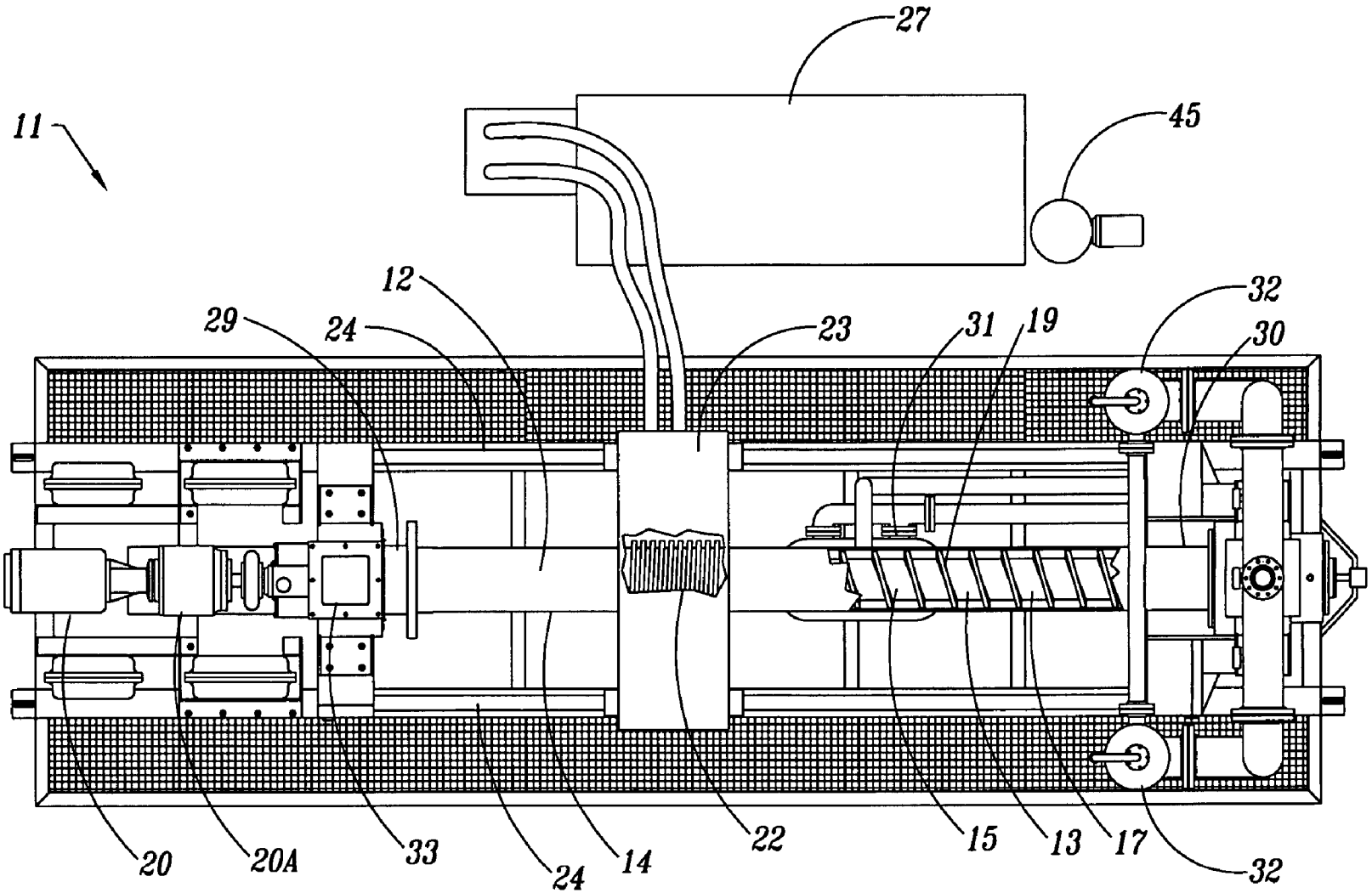
FIG. 3 is a top plan view with partial cut-away views of a preferred embodiment of the induction dryer, condensing chamber, and induction transformer.
Figure 4:
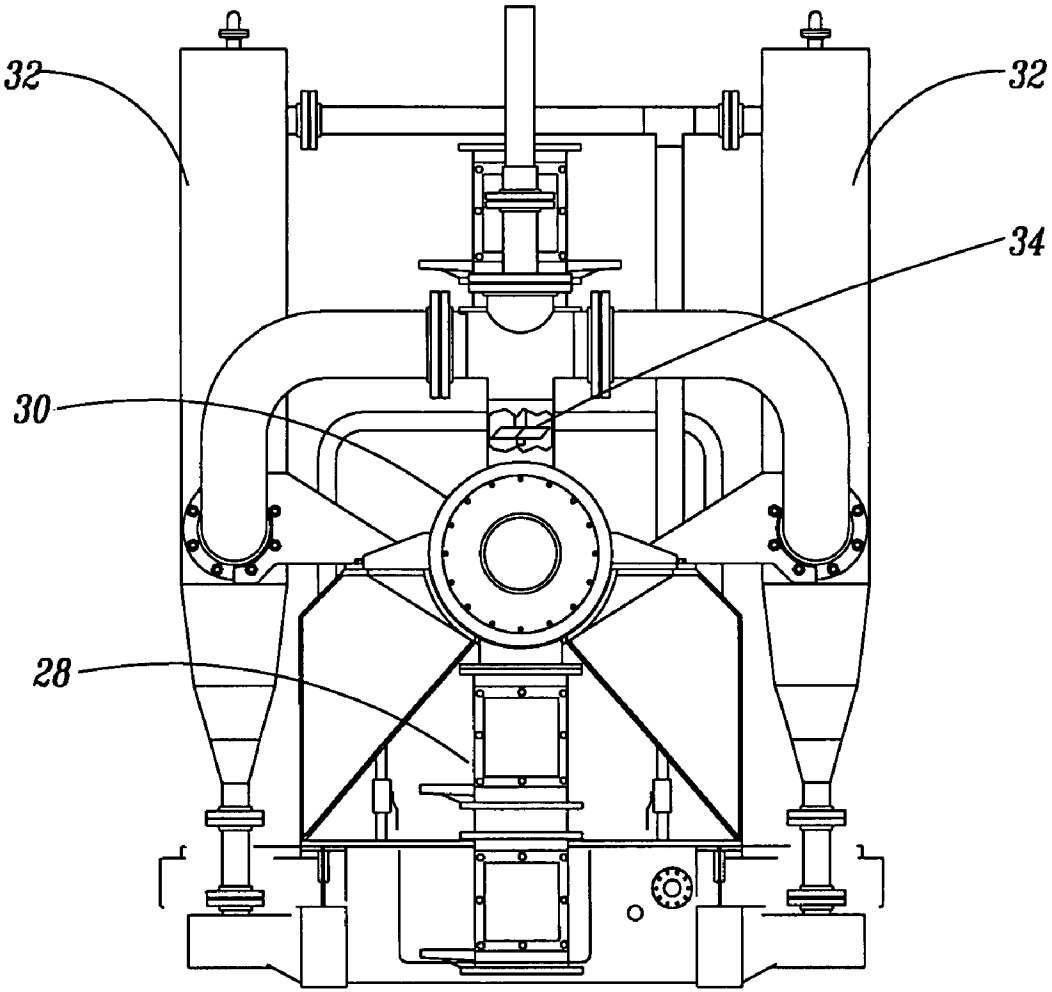
FIG. 4 is an end view with partial cut-away views of a preferred embodiment of the induction dryer and condensing chamber.
Figure 5B:
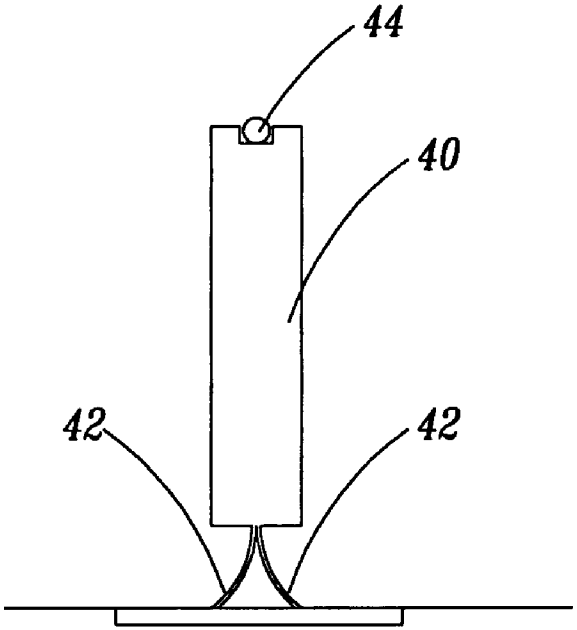
FIG. 5B is a cross-sectional view of the preferred embodiment of a vacuum seal shown in FIG. 5A taken along line S-S in FIG. 5A.
Figure 5A:
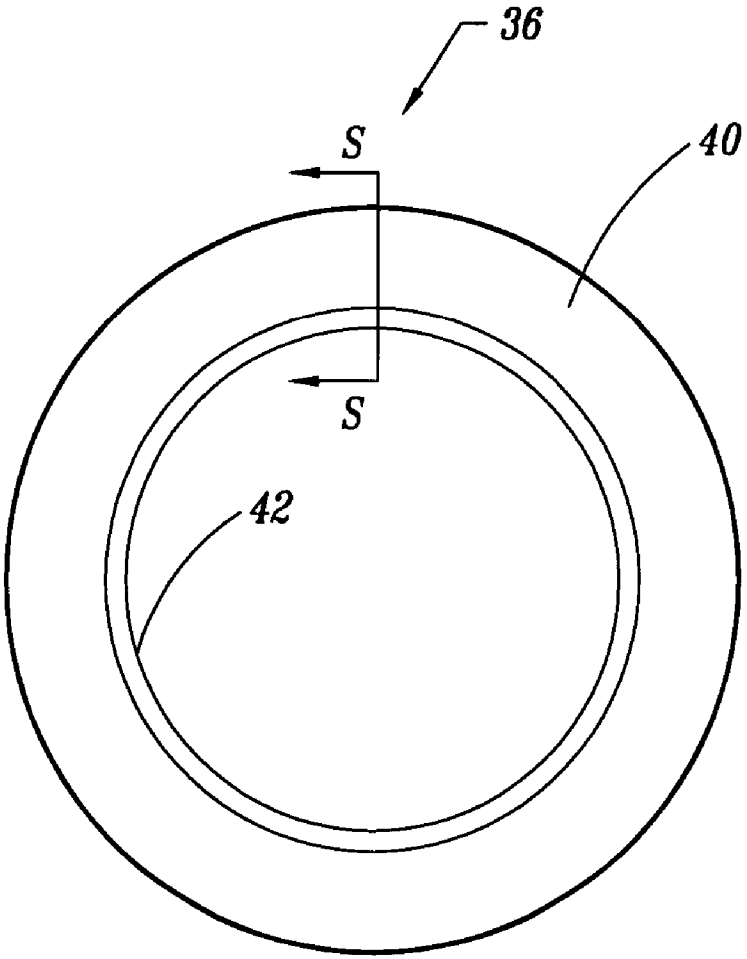
FIG. 5A is a side view of a preferred embodiment of a vacuum seal.
Figure 6:
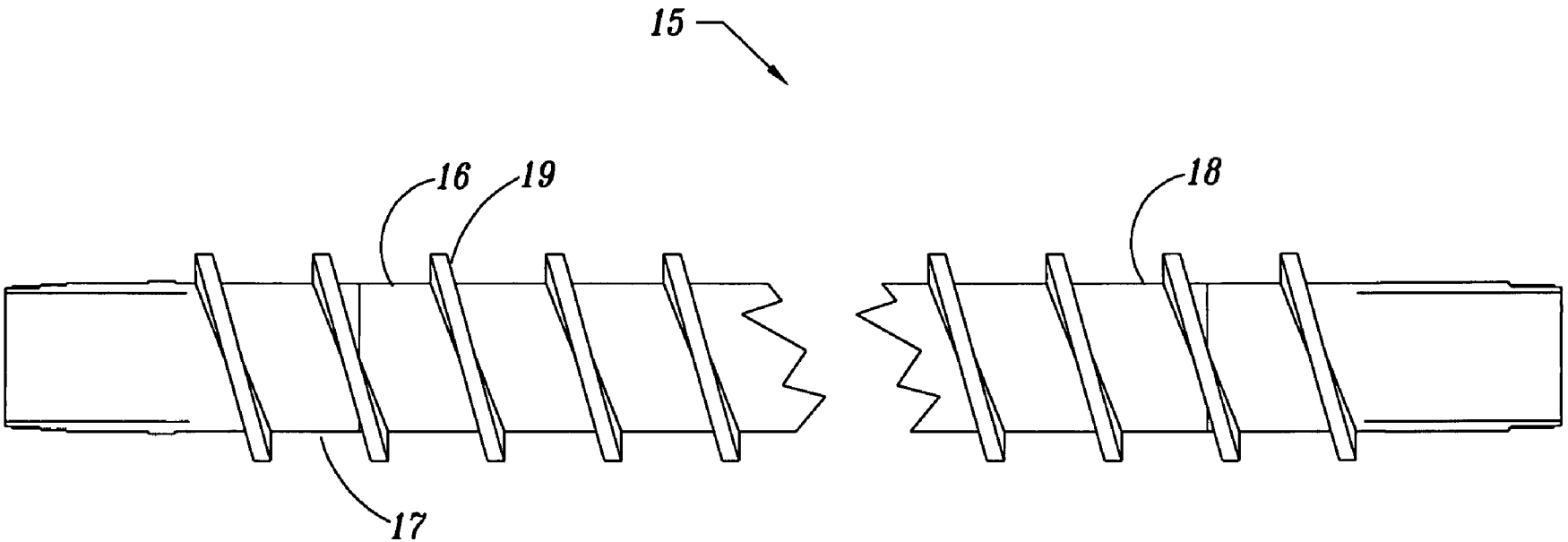
FIG. 6 is a side view of a preferred embodiment of a scroll.
Figure 7:
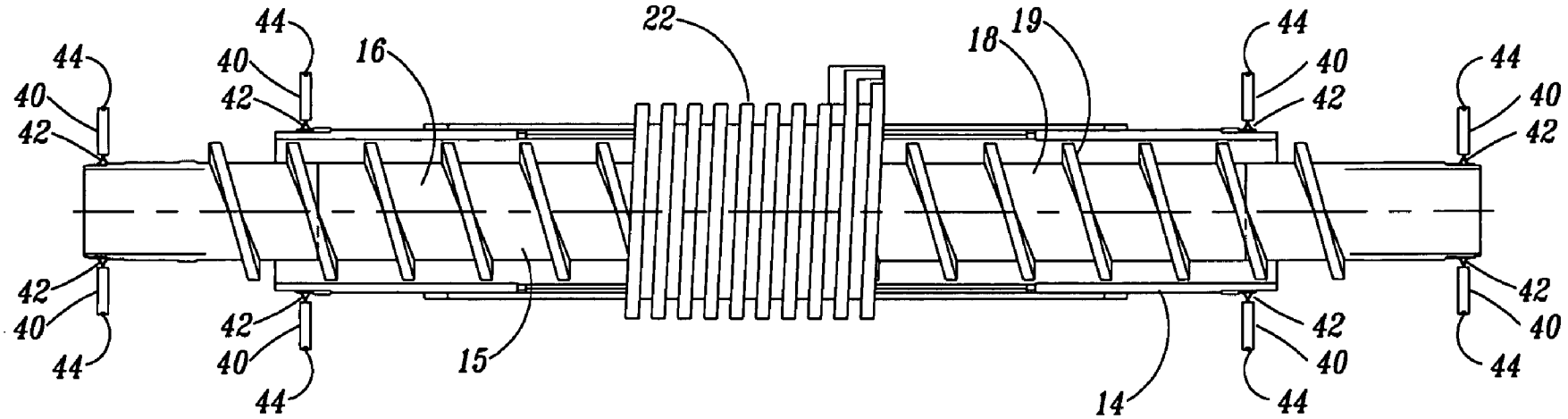
FIG. 7 is a partial cut-away view illustrating the engagement of the seal with the scroll and the housing.
Figure 8:
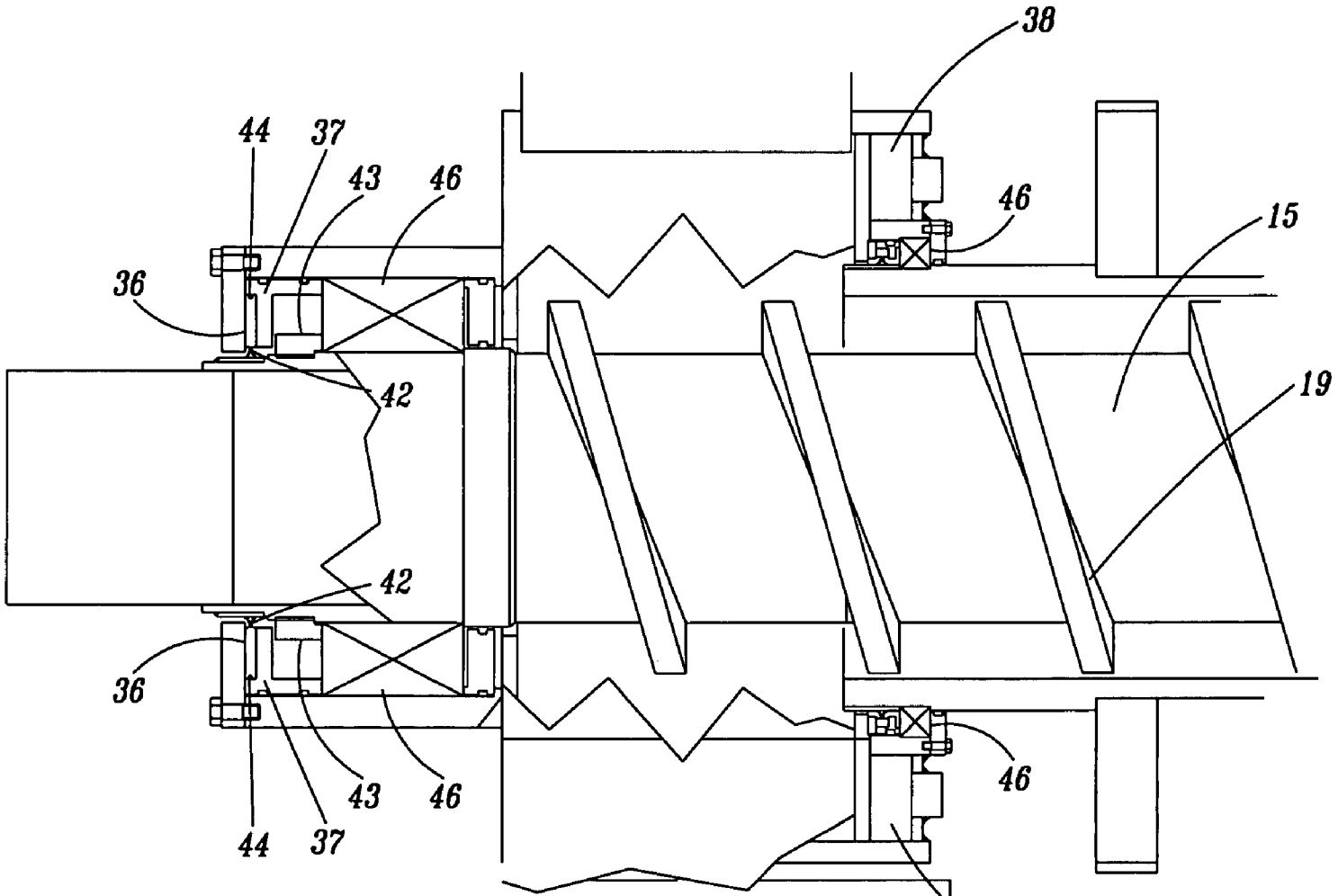
FIG. 8 is a partial cut-away detailed view of the seals at the scroll and housing.

A liquid solid separator 1 is disclosed. The preferred application of separator 1 is to separate petroleum well cuttings from the oil based drilling fluid used to remove the cuttings from the well bore. The cuttings are contained in a slurry composed primarily of water, oil based drilling fluid, and cuttings. The cuttings consist of small granular pieces of the well formation: bits of shale, sand, clay, and rock.

The separation process will preferably begin with a mechanical separation of the cuttings from the excess liquid in the slurry. This is preferably done in a mechanical dryer 2. In the preferred embodiment, mechanical dryer 2 comprises a dryer housing 3 having a dryer intake opening 4 preferably located at the top of housing 3. Inside housing 3 is a rotating screen 5 driven by a dryer motor 6. As screen 5 rotates, the liquids will be separated from the solids via centrifugal force. The separated fluid contaminants are collected for treatment and recycling or disposal while the cuttings will exit mechanical dryer 2 via dryer discharge opening 7.

Suitable mechanical dryers 2 are available from the Elgin Corp. of Columbus, Ohio. Numerous models are available from Elgin and other manufacturers. The appropriate size will depend upon the anticipated throughput of separator 1. Elgin's seventy-five horsepower model is expected to be adequate for most applications.

Upon leaving mechanical dryer 2, the cuttings will typically be dry to the touch. However, the fissures in the cutting granules will still contain a substantial amount of fluid. Additionally some cutting granules will be coated with fluid as well. Typically, the total weight of the cuttings will comprise about eighteen percent liquid at this stage, usually around 6.8 percent oil and 11.2 percent water. This level of contamination will preclude the cuttings from being discharged into the environment without further treatment.

In the preferred embodiment, upon leaving mechanical dryer 2, the cuttings will be transported, preferably via conveyor belt, to a serge tank 8. Serge tank 8 is preferably comprised of a hopper 9 with a screw auger 10 longitudinally positioned therein. Serge tank 8 ensures that the cuttings are delivered to the induction dryer 11 at a steady rate. Serge tank 8 could be omitted without adversely affecting the function of separator 1, although some adverse effects on the efficiency of separator 1 would be expected if the loading of induction dryer 11 were irregular.

The contaminated cuttings pass from serge tank 8 to induction dryer 11. Induction dryer 11 comprises an induction chamber 12. In the preferred embodiment, induction chamber 12 comprises a conveyor 13 and a housing 14. One purpose of conveyor 14 is to convey the cuttings through induction chamber 12. To that end, several conveyor forms would be suitable, including a continuous loop conveyor belt. However, the inventor's preferred embodiment of conveyor 13 is a scroll 15. Scroll 15 preferably comprises a hollow pipe 16 with a corkscrew type metal augur 17 positioned on its outer surface 18. Scroll 15 is preferably made of an electrically conductive metal such Inconel® 600 alloy (Inconel is a registered trademark of the Huntington Alloys Corporation of Huntington, W. Va.). Ideally, all of scroll 15 would be made of Inconel® 600. However, the inventor has found that forming the blades or flights 19 of augur 17 from 316 L stainless steel to be satisfactory. These 316 L stainless flights 19 can then be affixed to a schedule 100 pipe 16 made from Inconel® 600 to form scroll 15. Whatever material is used for conveyor 13, while being a conductor, it should be relatively resistant to electrical current. The preferred material, Inconel® 600, has a resistivity of about $1.02\times10^{-6}$ ohm meters. Suitable resistivity ranges will extend from about $1.6\times10^{-8}$ ohm meters to about about $1.5\times10^{-6}$ ohm meters. Conveyor 13 should also be resistant to abrasion so as to resist erosion by the materials that make up the cuttings. The Inconel® material used in the preferred embodiment has a relative magnetic permeability of about 1.0 and is, therefore, non-magnetic. Magnetic material could be used if desired in order to take advantage of the hysteresis heating.

Inconel® is a suitable material for scroll 15 for several other reasons. Ideally, any substitute material would exhibit these characteristics as well. Inconel® retains its strength at high temperatures. Obviously, for devices designed to generate high temperatures, this is desirable. Furthermore, the preferred design results in scroll 15 being unsupported except near ends 29 and 30 of housing 14. The strength of Inconel® will allow the length of scroll 15 to be maximized, which in turn will allow the volume of induction chamber 11 to be maximized. While other materials could be used, if they lacked the strength of Inconel®, particularly the strength at high temperatures, scroll 15 would have to be shortened. Otherwise, scroll 15 could deflect and rub on housing 14 as scroll 15 and housing 14 rotate, potentially damaging both. Inconel® is also resistant to cracking and corrosion that can arise in other materials from the heating and cooling cycles that will be typical in induction chamber 11.

Another advantage is that it would be possible to cast the entire scroll 15 as one member using Inconel®. Although this is not necessary for the operation of induction dryer 11, it is a useful option, particularly if large scale production is undertaken. Bearing journals can also be welded to the ends of scroll 15 if scroll 15 is made from Inconel®. This will allow more conventional materials, such as stainless steel to be attached to the scroll to allow it to be supported in bearings 46. Incidentally, those bearing should ideally be separated by about two feet from the end of the path of scroll 22 to prevent them from being heated excessively. Most preferably, the temperature of bearings 46 will remain below about 300° F.

Returning to Inconel®, it will expand evenly when heated and return to its original length upon cooling, provided its maximum operating temperature of about 1700° F. is not exceeded. Titanium would likely be a suitable substitute for Inconel®. Where it would be desirable to operate at higher temperatures than those needed in the preferred application of the invention, the substitution of titanium for Inconel® might be advisable. However, Inconel® is entirely suitable when separator 1 is used to treat cuttings from petroleum wells, such that the added expense of titanium makes it impractical. Other suitable materials undoubtedly exist, and the foregoing description of the advantages provided by Inconel® in the preferred application will hopefully assist in their identification.

Housing 14 will surround conveyor 13. Housing 14 will preferably comprise an elongated cylindrical tube having a longitudinal axis extending between ends 29, 30. Housing 14 is preferably positioned with a uniform clearance from conveyor 13 of about ⅛ to about 3⁄16 of an inch. Housing 14 is preferably non-magnetic, most preferably having a relative magnetic permeability of about 1.0. Care should taken to ensure that the components of housing 14, or at least that portions thereof affected by induction coil 22, discussed below, are substantially free of any ferromagnetic material. Housing 14, or at least its internal surfaces, should be resistant to abrasion from the materials that make up the cuttings. Housing 14 will also preferably be a good heat insulator. This may be accomplished by providing an insulating layer for housing 14. Finally, housing 14 should be an electrical insulator to avoid the induction of an electrical current in housing 14.

In the preferred embodiment housing 14 will be comprised of a hollow aluminum oxide (alumina, $Al_2O_3$) cylinder with a fiberglass sheath over the outer surface of the alumina cylinder. Alumina has a volume resistivity of about $1\times10^{9}$ to about $1\times10^{13}$ ohm meters which will allow it to be positioned within the electrical field of coil 22 without the induction of any substantial current in housing 14. Fiberglass also has a high electrical resistivity, making it suitable for use in housing 14. The preferred way of applying the fiberglass sheath is to position the alumina tube in a mold and apply the coating to its outside surface and then bake the fiberglass onto the alumina cylinder. The fiberglass sheath serves as a heat insulator. Other similar materials could be used in place of the fiberglass, provided they can be placed in the electrical field of coil 22 without the induction of any substantial electrical current. Alternatively, the fiberglass sheath could be omitted altogether, particularly where there is no substantial danger of contact between separator 1 and a flammable gas.

Another option for housing 14 would be non-magnetic, non-conductive woven carbon fiber provided with a ceramic liner to resist erosion.

Housing 14 and scroll 15, where conveyor 13 is comprised of scroll 15, are preferably configured to rotate independently of each other so that they may be rotated at different rates or so that one may be rotated and the other held stationary, as desired. In the preferred embodiment, scroll 15 and housing 14 are each mounted in bearings 46 and provided with independent drive motors 20, 21, although a common drive motor could be used if desired. In one preferred embodiment, scroll drive motor 20 is a variable speed motor to facilitate the rotation of scroll 15 at varying speeds. Scroll drive motor 20 may also be provided with a speed reducer 20A, to control its desired rate of rotation.

Induction dryer 11 further comprises an induction coil 22. Coil 22 preferably comprises a water cooled electrical coil such as those manufactured by the Radyne Company of 211 W. Boden St.; Milwaukee, Wis. Coil 22 is preferably mounted in a carriage 23. Housing 14 and conveyor 13 are centrally disposed within coil 22. Carriage 23 is configured to convey coil 22 back and forth along housing 14. In the preferred embodiment, carriage 23 is mounted on a track 24 provided with a chain drive 25 and limit switches 26. Chain drive 25 will propel carriage 23 and coil 22 along track 24 until carriage 23 triggers one of limit switches 26. At that point, chain drive 25 will reverse direction, causing carriage 23 and coil 22 to travel in the opposite direction until the opposing limit switch 26 is triggered, at which point chain drive will reverse again, ad infinitum. Chain drive 25 may be configured to propel carriage 23 and coil 22 at varying rates of speed, if desired. In the preferred embodiment, chain drive 25 will propel carriage 23 at a rate of between twelve and twenty-four feet per minute, with a delay time of about 2.5 seconds at the end of each passage before reversing course.

The operation of coil 22 depends on how the operator and/or designer wishes to heat conveyor 13. In the preferred application, it may be possible to effect the desired result simply by heating the surface of conveyor 13. This is easily accomplished using inductive heating. However, because the cuttings will be heated solely by convection, the inventor prefers to heat the full thickness of conveyor 13 in order to insure that there is sufficient heat present in conveyor to 13 to easily elevate the cuttings to the desired temperature. The frequency used will depend upon the material comprising conveyor 13 and the shape and thickness of conveyor 13 and the power of coil 22. In the preferred embodiment, conveyor 13 will comprise a scroll 15 made of ⅜th to ¾ inch thick Inconel® 600 pipe. Preferably, coil 22 will operate between about 500 and 1000 KW, and most preferably between about 750 and 820 KW. Under these conditions and with the goal of heating scroll 15 fairly uniformly from outer surface 18 to the inner surface of pipe 16, coil 22 will preferably operate between about 750 KHz and 1100 KHz. In applications where surface heating only is desired, different frequencies will be used. In the preferred embodiment an induction transformer 27 is used to control the current provided to coil 22. A transformer 27 such as those provided by Ajax Tocco Magnethermic Corp. of 1745 Overland Avenue; Warren, Ohio is expected to be well suited for use with separator 1. Transformer 27 will preferably be provided with a water cooling tower 45 to keep it and its controls from overheating.

Induction heating is well known in the art. See, e.g., U.S. Pat. No. 6,689,995. Essentially, inductive heating involves the use of an electrical coil. An AC power supply sends alternating current through the coil. When an electrically conductive object is placed within the coil, the alternating current will induce an alternating electrical current in the electrically conductive object opposite to the current in the coil. As the current in the coil alternates, so will the current in the object. Resistance to this current will generate heat in the object within the coil—eddy current heating (the Faraday phenomenon). Objects made from materials with relatively high resistivity to electrical current (e.g., carbon, steel, tungsten, and tin) will heat more rapidly from eddy current heating than objects made from material with relatively low resistivity to electrical current such as brass or copper.

Where the object within the coil is magnetic, a magnetic field will be induced in the object. The polarity of this magnetic field will oscillate as the current in the coil oscillates. The oscillation of the polarity of the magnetic field will also generate heat in the object—so called, hysteresis heating.

Because housing 14 is preferably made of a material that is substantially non-magnetic and that is substantially non-conductive of electricity, such as alumina or fiberglass, the inductive effects of coil 22 on housing 14 will be relatively minimal or nonexistent. However, because conveyor 13 will be made of a material that is an electrical conductor but that has relatively high electrical resistivity compared to copper, for example, the inductive effect of coil 22 on conveyor 13 will be significant. By positioning coil 22 over a desired location in conveyor 13, material in that area may be heated to a desired temperature. Moreover, housing 14 will not be heated significantly. This will be particularly important when separator 1 is used in the vicinity of flammable or combustible gases.

If housing 14 were heated significantly, it could create a potential flash point which could ignite such gases. By keeping housing 14 relatively cool, the danger of fire or explosion may be greatly reduced. The presence of an outer layer of fiberglass or other heat insulating material over the exterior of housing 14 will help to keep the exposed surfaces of housing 14 relatively cool. In operation, the outer layer of the preferred embodiment of housing 14 will preferably be about 150° F. or less. The present design is easily able to keep all surfaces of separator 1 exposed to the atmosphere below about 200° F. During testing of the preferred embodiment, scroll 15 was heated to 1700° F. At this temperature, the exterior surface of housing 14 only reached 285° F. When scroll 15 was heated to 1100° F., still far above the temperatures that will be required during operation in the preferred application, the outer surface of housing 14 only reached about 150° F.

In one embodiment, separator 1 may also be provided with electrical resistance heating elements within scroll 15 in addition to induction coil 2. These can serve to heat the contents of separator 1 as well.

A partial vacuum is preferably maintained within housing 14. In the preferred embodiment, this is accomplished by providing an air lock 28, at the intake end 29 and discharge end 30 of housing 14. Suitable air locks 28 may be obtained from the Plattco Corp., 7 White Street; Plattsburg, N.Y. A vacuum pump 31 and one or more condensing chambers 32 are also preferably provided at discharge end 30 of housing 14. Condensing chambers were manufactured specially for the embodiment tested; however, suitable condensing chambers are commercially available from the Natco Company of 5315 Curtis Lane, New Iberia, La. Vacuum pump 31 will preferably operate at about 350 cubit feet per minute and maintain a vacuum in the space between housing 14 and conveyor 13 of at least about 21 to 28 inches of mercury (note that 35 inches of mercury is the pressure in a complete vacuum). It will be appreciated that air locks 28 will necessarily allow a small amount of air to enter housing 14 as the cuttings enter or exit. However, the amount of air that enters will be minimal, and it can be quickly removed by vacuum pump 31.

During operation of the preferred embodiment, cuttings will be conveyed from serge tank 8 to a point above air lock 28 at intake end 29 of housing 14. Cuttings entering separator 1 will typically be between about 40° F. and 125° F. Before entering air lock 28, the cuttings will preferably pass through a sizing unit 33. Sizing unit 33 will insure that cuttings are the appropriate size, preferably, less than ⅜ of an inch in diameter. Objects larger than this size will be excluded by sizing unit 33 which, in the preferred embodiment, comprises a set of rollers spaced apart by the threshold distance. Suitable sizing units may be obtained from the American Pulverizer Company of 5540 W. Park Avenue; St. Louis, Mo.

Once through the initial air lock 28, the cuttings will be conveyed through housing 14 by conveyor 13. Where conveyor 13 is scroll 15, the counter-clockwise rotation of scroll 15 will move the cuttings through housing 15. The angle or pitch of flights 19 and the rate of rotation of scroll 15 will determine the rate at which the solids move through housing 14 where scroll 15 is used as conveyor 13. In the preferred embodiment, scroll 15 will rotate at about thirty rotations per minute or less, and flights 19 will have an angle of about twenty-two degrees. Housing 14 will preferably rotate between about fifteen and thirty-five rotations per minute. In the preferred embodiment, cuttings are typically expected to move through housing 14 at a rate of about fifteen thousand pounds per hour.

As noted above, housing 14 will preferably rotate independently of scroll 15. While housing 14 and scroll 15 will preferably rotate in the same direction, they will preferably not rotate at the same rate. This will help stir the cuttings and prevent cuttings from caking or clumping to conveyor 13 or housing 14 as cuttings move through induction chamber 12, all of which will enhance drying. Additionally, as the scroll 15 and housing 14 rotate, a rock film will be formed from the cuttings. This film will form a thin coat on the inner surface of housing 14, which will help to protect the alumina of the preferred embodiment from abrasion.

In the preferred embodiment, the interior of scroll 15 will be pressurized with a non-flammable gas such as nitrogen. Doing so will effectively close the interior of scroll 15 to the atmosphere and will limit the ability of any flammable gases to enter the interior of scroll 15—a potentially significant accomplishment because the interior of scroll 15 will be hot during the operation of separator 1 and could serve as a flash point in the event of a blow out.

It will be appreciated that a seal at both ends of housing 14 will facilitate the maintenance of the desired vacuum. Seals 36 will be required primarily at intake end 29 and discharge end 30 of housing 14. In the preferred embodiment, these will be provided primarily where scroll 15 enters induction chamber 12, at each end of housing 14, and where the scroll exits induction chamber 12. In the preferred embodiment, the path of coil 22 ends about three to ten inches before the ends of scroll 15. This will further separate the portions of scroll 15 directly heated by coil 22 from seals 36 and bearings 46 and the bearing journals at each end of scroll 15, thereby minimizing the risk that these items might be affected by the heat.

In the preferred embodiment, seals 36 comprise an annular frame 37, preferably of steel. A cooling channel 38 is provided, through which a water jacket is pumped. Pumping rates of only a gallon or two per minute are expected to be sufficient to keep seal 36 at or below the desired ceiling temperature of about 200° F. By regulating the temperature of seals 36, the water jackets will prevent seals 36 from expanding and thereby prevent or lessen the frequency with which seals 36 are lost.

In the preferred embodiment, annular frame 37 includes a gland chamber. A gland 40 will be provided within the gland chamber. Gland 40 will preferably be made of a soft rubber-like plastic such as Tucron, available from the American Variseal of 510 Burbank Street of Broomfield, Colo. An O-ring 44, preferably of fluorocarbon, is preferably positioned between gland 40 and annular frame 37. At the contact end of the preferred embodiment of gland 40, opposite a gasket 41, are a pair of divergent sealing arms 42. Sealant arms 42 will each contact the outer surface of housing 14 or scroll 15, forming the seal. Sealant arms 42 will create three distinct areas: an exterior area comprising the atmosphere exterior to the seal bordering on gland 40; an interior area comprising the environment within housing 14 bordering on gland 40; and a buffer area between sealing arms 42. The purpose of seal 36 is obviously to separate the interior area from the exterior area. The buffer area helps prevent leakage across seal 36.

In the preferred embodiment, housing 14 and scroll 15 are provided with a hardened collar 43 made of, for example, 78 Rockwell steel. Seal 36 will contact collar 43 rather than contacting housing 14 or scroll 15 directly. In the absence of collar 43, seal 36 will erode the housing 14 and/or scroll 15 over time, resulting in the loss of the seal.

As coil 22 passes over housing 14, conveyor 13 will be heated via induction as described above. The cuttings, which will be in contact with conveyor 13, will be heated as well. The increased temperatures will cause the water and oils contaminating the cuttings to vaporize.

The existence of a vacuum within induction chamber 12 will lower the temperature at which the contaminants will vaporize. This will allow the internal temperatures of separator 1 to be maintained at lower levels than would be possible if vaporization were conducted at atmospheric pressure. That in turn will reduce the risk that any part of separator 1 will be hot enough to serve as a flash point in the event of a blow out. Conducting the separation under a vacuum and at the correspondingly lower vaporization temperatures will also reduce the risk that any of the vaporized contaminants will be ignited in separator 1. The vacuum will also reduce the amount of electrical energy that must be expended to vaporize the cutting contaminants, improving the efficiency of the process. Finally, the vacuum will also serve as a convenient system for collecting the vaporized contaminants.

It will generally be preferable to maintain the temperature of the cuttings in induction chamber 12 between about 400° F. and about 500° F. At this temperature and at the desired level of vacuum, substantially all of the contaminants will be removed from the cuttings as they pass through separator 1. However, it should be noted that this temperature range has been selected to provide a margin of safety that will ensure that substantially all of the expected contaminants will be vaporized. It is expected that the presence of the vacuum will allow most, if not all, contaminants encountered in petroleum well cuttings to be fully vaporized at around 250° F. Thus, where energy efficiency is an overriding concern, induction chamber may be operated at the lower temperature and still achieve substantial separation of the cuttings from their liquid contaminants.

When the cuttings reach the discharge end 30 of housing 14, they will exit via a second air lock 28. The cuttings will be substantially free of oil or water at this point and may be collected for disposal, either by dumping them overboard when offshore or burying them in a landfill when on shore. Alternatively, the cuttings may be used as construction or other civil engineering material as desired.

Vacuum pump 31 will pull the vapor stream through a filtration system, preferably positioned at discharge end 30 of housing 14. During separation, particulate matter may become entrained in the vapor stream. The filtration system is intended to remove such particulate matter from the vapor stream. Conventional membrane or mesh filters may be used for this purpose, if desired. However, these have a disadvantage in that they must be changed as they become clogged. In the preferred embodiment, the filtration system includes a wizzard 34. A wizzard is, in essence, a slow moving fan. Vacuum pump 31 pulls the vapor stream through the blades of wizzard 34. The gaseous portions have no trouble moving around the blades; however, most particulate matter will strike the blades, which will deflect them from the vapor stream. Once removed, the particulate matter will fall out, preferably into the second air lock 28 with the rest of the treated solids.

After wizzard 34, the vapor stream will enter one or more condensing chambers 32. A water shower is provided in condensing chambers 32. Preferably the nozzles for the showers will be sonic nozzles, and the water entering showers 35 will preferably be filtered to avoid clogging. Showers 35 will wet any solids that may remain in the vapor stream causing them to fall out of the vapor stream.

Typically, the vapor stream will be about 370° F. to 500° F. when it exits housing 14. Showers 35 will cool the vaporized chemicals in the vapor stream, causing them to condense. The result will be a fluid and solid mixture which can be collected for further treatment, separation of the collected chemicals for recycling, or disposal. Air exiting the separator downstream of the shower condensers will be about 72° F. It may typically be vented to the atmosphere. Alternatively, it may be collected for further treatment or mixed with other fuel for burning to ensure all chemicals in the vapor stream have been removed.

It is noted that because the temperatures reached by the vaporized contaminants in separator 1 are relatively low, the liquid chemicals collected at the end of the process are less likely to have degraded during separation. The presence of the vacuum also help prevent degradation of the extracted chemicals. As soon as the chemical contaminants are vaporized, the vacuum immediately draws them to the condensing chambers 32 where they are cooled and condensed. Thus, there is little time in which the contaminants are in a vaporized state at an elevated temperature, the conditions under which chemical degradation is most likely to occur. Accordingly, the collected fluids are generally suitable for recycling after they have been separated from the cuttings. Given the cost of many of the chemicals used in drilling fluids, the savings represented by the ability to reuse these chemicals are not insignificant.

The foregoing notwithstanding, the vapor stream extracted from separator 1 maybe flashed or burned where environmentally acceptable. Depending on the nature of the contaminants on the cuttings or other solids and the conditions in the surrounding environment, burning may be an appropriate way of dealing with the contaminants once they are separated from the solids.

In the preferred embodiment, a plurality of thermocouples (not shown) may be provided on the inside of scroll 15, preferably one about every twelve inches along scroll 15. Thermocouples, such as those provided by the Thermal Corporation of 1264 Slaughter Road; Madison, Ala. are expected to be suitable. These thermocouples will provide temperature data to a central processing unit (CPU). The CPU will be in communication with the motor that drives coil carriage 23. Carriage 23 will ordinarily advance at a rate of about twenty-one feet per minute. However, when a local temperature is reading below a desired level, carriage 23 and coil 22 may be slowed. Conversely, when the temperature is high, carriage 23 and coil 22 may be accelerated. In addition or in the alternative, the CPU may also vary the current levels in coil 22 in order to control the temperature of scroll 15, where more current will result in a higher temperature and vice versa. In this fashion, the contents of the separator may be maintained at the desired temperature.

It is expected that, using the preferred embodiment, up to 7.5 tons of cuttings per hour can be processed. In testing, 10,395 pounds of cuttings were processed per hour (~5.2 tons/hr). When the processed cuttings were analyzed, they were found to contain no water and less than 1.0 percent oil, by weight.

The efficiency of separator 1 arises in part from the fact that the use of the vacuum allows vaporization to occur at lower temperatures than would be required at atmospheric pressure and from the fact that very little of the heat generated by separator 1 is lost. The major dissipation of heat generated in separator 1 will occur via transfer from scroll 15 to the cuttings and then via vaporization of the liquid contaminants in the cuttings. The vaporized contaminants will be immediately removed by the vacuum. Because virtually all of the heat produced by separator 1 is generated in scroll 15 and because essentially the only way for that heat to dissipate is through the cuttings surrounding scroll 15, virtually all of the heat generated by separator 1 is ultimately harnessed for vaporization. Therefore, separator 1 is highly efficient when compared to other separators common in the industry.

For comparison, consider the heat required to vaporize contaminated cuttings using a conventional rotary kiln at atmospheric pressure. The cutting slurry will typically consist of about sixty-five percent solids, fifteen percent oil, and twenty percent water. (The preferred embodiment of the present invention uses mechanical dryer 2 to reduce the water and oil percentages, which increases the efficiency of separator 1. However, this comparison will ignore any advantages gained via mechanical dryer 2.) At atmospheric pressure, water boils at 212° F. and most oils are vaporized by 410° F. This can be contrasted with the conditions of the preferred embodiment, where during testing pressure ranged from about 8.92 inches of mercury at the end of housing 14 closest to vacuum pump 31 to about 2.92 inches of mercury at the end of housing 14 distal from vacuum pump 31. During testing, only one air lock 28 was used. Thus, the opposite end of the induction housing was open to the atmosphere. Under these conditions, vacuum pump 31 could only maintain the vacuum levels reported above. Nonetheless, under these conditions, water will boil at 157° F. and most oils will vaporize at 250° F.

At 7.5 tons of cuttings per hour, the heat requirements of a conventional rotary kiln will be 3,306,900 BTU/hr for the water; 618,300 BTU/hr for the oil; and another 720,720 BTU/hr for the solids (Note: heat transfer constants for decane and clay were used in determining the heat requirements for the oil and solids.) By contrast, under the vacuum conditions of the preferred embodiment, the same amount of water will only require 3,222,000 BTU/hr; the oil will only require 463,300 BTU/hr; and the solids, 371,280 BTU/hr.

It will be noted that the energy required to heat the solids represents a substantial portion of the savings. This flows from the fact that the solids make up the greatest percentage of the cuttings slurry by weight, but that they are only being heated to effect vaporization of the liquid components. That is, although the oils make up only fifteen percent by weight of the slurry, separation requires that the much larger mass of solids be heated to the vaporization temperature of the oil before the oils can be fully vaporized. By reducing the maximum temperature required to vaporize the oils by 160° F., the temperature to which the solids must be heated is reduced as well. Stated differently, at 7.5 tons of cuttings slurry per hour, operating under the vacuum of the preferred embodiment means that every hour, 4.9 tons of solids must only be heated to 250° F. rather than 410° F.

These savings increase substantially when the relative efficiencies of the two systems are considered. Heat losses of as much as sixty percent are believed to be common in propane or natural gases burner systems. The heat losses of the present system have not yet been determined experimentally. However, because the heat is generated in scroll 15 and can only escape via the cuttings that surround scroll 15, losses in the present system are believed to be very low and certainly less than twenty percent.

Although the foregoing description has been provided in the context of petroleum well cuttings, it will be appreciated that other solid liquid mixtures could be separated in the same manner. Accordingly, such other uses and embodiments of the invention that will occur to those skilled in the art from the foregoing disclosure, and are intended to be included within the scope and spirit of the claims which follow.

I claim:

1. A liquid solid separator comprising:

an induction dryer comprising a substantially air tight housing having an intake end and a discharge end configured to allow the passage of solids into and out of said housing while substantially preventing the passage of air into or out of said housing;

a vacuum pump in fluid communication with said housing, said vacuum pump configured to establish a partial vacuum within said housing;

a conveyor disposed within said housing, said conveyor configured to convey solids through said housing; and an induction coil positioned around said housing, said coil configured to envelope at least a portion of said housing within an alternating electrical current, wherein said portion of said housing enveloped within said alternating electrical current is substantially non-magnetic and substantially non-conductive of electricity and wherein said conveyor is comprised of materials that are conductive of electricity, whereby operation of said coil will induce heating in said conveyor, whereby said heated conveyor will heat said solids, and whereby substantially no heating will be induced in said housing.

2. A liquid solid separator according to claim 1 wherein said conveyor is comprised of materials having an electrical resistivity of at least about $1.0\times10^{-6}$ ohm meters.

3. A liquid solid separator according to claim 1 wherein said conveyor is comprised of materials having an electrical resistivity between about $1.6\times10^{-8}$ ohm meters to about about $1.5\times10^{-6}$ ohm meters.

4. A liquid solid separator according to claim 1 wherein said housing has an outer surface and wherein said housing further comprises a heat insulating layer disposed on said outer surface.

5. A liquid solid separator according to claim 4 wherein said heat insulating layer is comprised of fiberglass.

6. A liquid solid separator according to claim 1 wherein said conveyor comprises a rotatable scroll.

7. A liquid solid separator according to claim 6 wherein said housing further comprises an elongated body having a longitudinal axis extending between said intake end and said discharge end.

8. A liquid solid separator according to claim 7 wherein said coil is configured to move along said housing substantially parallel to said longitudinal axis.

9. A liquid solid separator according to claim 8 wherein said housing is provided with a plurality of thermocouples and wherein said thermocouples are in operative communication with a central processing unit and wherein said central processing unit is configured to correlate the movement of said coil with the readings provided by said thermocouples.

10. A liquid solid separator according to claim 6 wherein said scroll further comprises an inner chamber and wherein said inner chamber is pressurized with a non-flammable gas.

11. A liquid solid separator according to claim 10 wherein said gas comprises nitrogen.

12. A liquid solid separator according to claim 1 further comprising a condensing tower in fluid communication with said housing and said vacuum pump, wherein said vacuum pump is configured to pull vapors from said housing into said condensing tower.

13. A liquid solid separator according to claim 12 further comprising a wizzard positioned between said condensing tower and said housing, whereby said vapors and any solids entrained in said vapors exiting said housing must pass through said wizzard to reach said condensing tower.

14. A liquid solid separator according to claim 13 further comprising a mechanical dryer configured to remove excess liquids from said solids before said solids enter said induction dryer.

15. A liquid solid separator according to claim 1 wherein said vacuum pump is configured to generate a partial vacuum within said housing of at least about twenty-one inches of mercury.

16. A liquid solid separator according to claim 1 wherein said portion of said housing enveloped within said alternating electrical current consists essentially of materials having a magnetic permeability of about 1.0.

17. A liquid solid separator comprising an induction dryer comprising a substantially air tight housing having an intake end and a discharge end configured to allow the passage of solids into and out of said housing while substantially preventing the passage of air into or out of said housing;

a vacuum pump in fluid communication with said housing, said vacuum pump configured to establish a partial vacuum within said housing;

a conveyor disposed within said housing, said conveyor configured to convey solids through said housing; and an induction coil positioned around said housing, said coil configured to envelope at least a portion of said housing within an alternating electrical current, wherein said portion of said housing enveloped within said alternating electrical current consists essentially of electrically non-conductive materials having a magnetic permeability of about 1.0 and wherein said conveyor is comprised of electrically conductive materials, whereby operation of said coil will induce heating in said conveyor, whereby said heated conveyor will heat said solids, and whereby operation of said coil will induce substantially no heating in said housing.

18. A liquid solid separator according to claim 17 wherein said conveyor is comprised of materials having an electrical resistivity of at least about $1.0\times10^{-6}$ ohm meters.

19. A liquid solid separator according to claim 17 wherein said conveyor is comprised of materials having an electrical resistivity between about $1.6\times10^{-8}$ ohm meters to about $1.5\times10^{-6}$ ohm meters.

20. A liquid solid separator according to claim 17 wherein said housing has an outer surface and wherein said housing further comprises a heat insulating layer disposed on said outer surface.

21. A liquid solid separator according to claim 17 wherein said conveyor comprises a rotatable scroll.

22. A liquid solid separator according to claim 21 wherein said housing further comprises an elongated body having a longitudinal axis extending between said intake end and said discharge end.

23. A liquid solid separator according to claim 22 wherein said coil is configured to move along said housing substantially parallel to said longitudinal axis.

24. A liquid solid separator according to claim 23 wherein said housing is provided with a plurality of thermocouples and wherein said thermocouples are in operative communication with a central processing unit and wherein said central processing unit is configured to correlate the movement of said coil with the readings provided by said thermocouples.

25. A liquid solid separator according to claim 21 wherein said scroll further comprises an inner chamber and wherein said inner chamber is pressurized with a non-flammable gas.

26. A liquid solid separator according to claim 17 wherein said housing is rotatable.

27. A liquid solid separator according to claim 17 wherein said portion of said housing enveloped within said alternating electrical current is comprised of alumina.

28. A method of separating solids from liquids impregnated in said solids comprising Placing said solids in a liquid solid separator comprising an induction dryer comprising a substantially air tight housing having an intake end and a discharge end configured to allow the passage of said solids into and out of said housing while substantially preventing the passage of air into or out of said housing; a vacuum pump in fluid communication with said housing, a conveyor disposed within said housing, said conveyor configured to convey solids through said housing; and an induction coil positioned around said housing, said coil configured to envelope at least a portion of said housing within an alternating electrical current, wherein said portion of said housing enveloped within said alternating electrical current consists essentially of electrically non-conductive materials having a magnetic permeability of about 1.0 and wherein said conveyor is comprised of electrically conductive materials, generating a partial vacuum within said housing;

generating an alternating electrical current in said coil;

inducing heat in said conveyor sufficient to vaporize liquids at the vacuum level present in said housing;

drawing said vaporized liquids away from said solids.

29. A method of separating solids from liquids impregnated in said solids according to claim 28 further comprising maintaining the temperature of all surfaces of said separator exposed to the atmosphere below about 150° F. when the internal temperature of the conveyor is below about 1000° F.

30. A method of separating solids from liquids impregnated in said solids according to claim 29 wherein said conveyor comprises a scroll having an inner chamber and wherein said method further comprises pressurizing said inner chamber with a non-flammable gas.

31. A method of separating solids from liquids impregnated in said solids according to claim 30 wherein said housing has an outer surface and wherein said housing further comprises a heat insulating layer disposed on said outer surface.

* * * * *